United States Patent [19]

Krueger et al.

[11] 4,362,138

[45] Dec. 7, 1982

[54] CHANGEABLE LENGTH ACCELERATOR-CARBURETOR-SPEED REGULATOR LINKAGE

[75] Inventors: Ronald M. Krueger, Wrightsville Beach; Harry D. Sturdy, Wilmington, both of N.C.

[73] Assignee: Sturdy Truck Equipment, Inc., Wilmington, N.C.

[21] Appl. No.: 252,224

[22] Filed: Apr. 8, 1981

[51] Int. Cl.[3] ..... F02D 1/08; F02D 1/04; F02D 31/00; F02D 33/00

[52] U.S. Cl. ..... 123/342; 123/320; 123/340; 123/352

[58] Field of Search ..... 123/342, 320, 340, 352, 123/361, 363, 341, 376, 396

[56] References Cited

U.S. PATENT DOCUMENTS

| | | | |
|---|---|---|---|
| 2,328,452 | 8/1943 | Hobart | 123/342 |
| 2,365,412 | 12/1944 | Jones | 123/342 |
| 2,742,792 | 4/1956 | La Goste | 123/341 |
| 3,923,020 | 12/1975 | Gilligan | 123/342 |
| 4,100,893 | 7/1978 | Butcher | 123/342 |
| 4,181,103 | 1/1980 | Sturdy | 123/342 |
| 4,252,090 | 2/1981 | Baugh | 123/340 |

*Primary Examiner*—Raymond A. Nelli

*Attorney, Agent, or Firm*—Richards, Shefte & Pinckney

[57] ABSTRACT

A spring-loaded cartridge or capsule forms a connecting link for inclusion in the accelerator-throttle linkage of an internal combustion engine to convert such linkage to a changeable length linkage which permits an overriding governing action to close the throttle against the action of the accelerator without significant effect on the operation or feel of the accelerator. The operation or feel of the accelerator is not affected because the spring-loading of the cartridge is only slightly stronger than the normal throttle-closing spring which constantly urges the throttle toward its closed position.

6 Claims, 3 Drawing Figures

PULL TO OPEN
WIDE OPEN THROTTLE
CLOSED THROTTLE

CHANGEABLE LENGTH ACCELERATOR-CARBURETOR-SPEED REGULATOR LINKAGE

BACKGROUND OF THE INVENTION

Internal combustion engine speed regulators combined with changeable length accelerator linkages have been well-known in the prior art, U.S. patent application Ser. No. 168,566 filed July 14, 1980, and U.S. Pat. No. 4,181,103 being most pertinent, although U.S. Pat. Nos. 2,365,412, 2,742,792, 2,328,452, 3,721,309, 3,923,020, and 4,059,025 also disclose relevant subject matter.

While all the above-mentioned prior art discloses changeable length accelerator linkages which allow one throttle control means to override another, none of them permit normal operation and "feel" of the conventional accelerator pedal when the speed regulator or governor is actively limiting throttle opening; and, conversely, they do not permit the governor to close the throttle from an open position (as determined by operation of the coventional accelerator pedal) without significant "feedback" or alteration of the "feel" or position of the accelerator pedal.

The aforesaid application Ser. No. 168,566 indicates that the accelerator pedal will have a generally "normal feel" just as a conventional accelerator pedal and throttle linkage, but that indication was made in the context of the most pertinent prior art known at that time, principally the aforesaid U.S. Pat. No. 4,181,103. The changeable length accelerator-carburetor-governor linkage of U.S. Pat. No. 4,181,103 operated such that when the governor held the throttle fully closed it also held the accelerator fully depressed, and if the governor operated to lengthen the linkage when the accelerator was fully up and the throttle thereby already closed, then the governor would draw the accelerator pedal down to the floorboard, both being highly unnatural actions so far as the "normal feel" of the accelerator pedal was concerned. Also, since the flexible sheath of the flexible cable portion of this linkage was not anchored at the carburetor end thereof, but was movable with the extending end of the throttle arm, the flexible sheath was flexed laterally with each throttle arm movement and thereby subject to interference with various nearby engine components, causing wear or other problems.

Therefore, the "normal feel" described in the aforesaid application Ser No. 168,566 referred to the fact that the accelerator pedal thereof was not forcibly depressed or "taken away" from the operator when the governor acted to close the throttle, but the accelerator pedal could be positioned as desired but without effect on the throttle position. However, a spring, described as "substantially stronger" than the spring which normally holds the throttle closed, forms the changeable length element of the accelerator-carburetor-governor linkage of application Ser. No. 168,566, and the added force of this "substantially stronger" spring must be resisted by the operator in order to hold an accelerator pedal position in opposition to throttle-closing action by the governor.

The "feel" of such a linkage may be "normal" in the directional sense as compared to the abnormal directional feel of the apparatus of U.S. Pat. No. 4,181,103 or to a common or conventional fixed-length accelerator-throttle linkage, but it is not "normal" in the sense of the substantially stronger force required to depress or hold the accelerator pedal against throttle closing or governing action of the governor as compared to its "normal" operation when the governor is not governing. Also, the forces involved appeared in practice to be dangerously strong for long-term use without damage to the conventional components of the linkage.

The changeable length linkage of the present invention not only provides normal feel in the directional sense as does the application Ser. No. 168,566 (i.e., the accelerator pedal is never "taken away" from the operator), but also in the sense that the force required to depress or hold the accelerator against throttle-closing governing action by the governor will be only slightly stronger than the force required when the governor is not governing. Thus, the operation, or operational feel, of the accelerator pedal of the present invention is not significantly affected, either as to the direction of motion or the force required, by the operation of the governor, thereby providing a significantly advantageous and saleable feature for a changeable length accelerator-carburetor-governor linkage.

SUMMARY OF THE INVENTION

The present invention includes a throttle actuator for an engine having a throttle, a governor, and a driver operated accelerator means, the actuator including first biasing means associated with the throttle for biasing it toward its closed position; throttle linking means adapted to be connected between the accelerator means and the throttle and having a predetermined effective length for normally permitting the accelerator means to control the energy supply to the engine by exerting force on the throttle sufficient to overcome the biasing force exerted by the first biasing means for positioning the throttle in opposition to the first biasing means between full open and full closed positions; an overriding throttle closing linkage operated by the governor and associated with the throttle for exerting force thereon in opposition to the force exerted thereon by the throttle-linking means to urge the throttle toward its closed position under the influence of the governor; and means associated with the throttle-linking means for changing the predetermined effective length thereof when the accelerator means is operated to move the throttle from its closed position and the overriding linkage is operated to move the throttle toward its closed position, the length changing means including a connecting link having relatively movable elements associated respectively with the accelerator means and the throttle, and second biasing means slightly stronger than the first biasing means for normally maintaining the movable elements in fixed relation to one another by exerting force therebetween during normal operation of the throttle by the accelerator means and for permitting relative movement of the movable elements to change the effective length of the throttle-linking means when the combined forces exerted by the first biasing means and the overriding linkage exceed the force exerted by the second biasing means in opposition thereto, whereby operation of the accelerator means is not significantly affected by the operation of the overriding means.

Further, the aforesaid connecting link is self-contained and has a follower movable lengthwise of the throttle-linking means and the second biasing means biases the follower against a fixed portion of the connecting link and allows the follower to move away from the fixed portion for the aforesaid length changing.

Preferably, the connecting link essentially extends beyond the throttle away from the accelerator means or, alternatively, may be located essentially between the throttle and the accelerator means.

In one disclosed embodiment of the present invention, the length changing means is shortened by the aforesaid length changing arrangement and in an alternative disclosed embodiment the length changing means is lengthened by such length changing arrangement.

DESCRIPTION OF THE PREFERRED EMBODIMENTS

Figure 1:
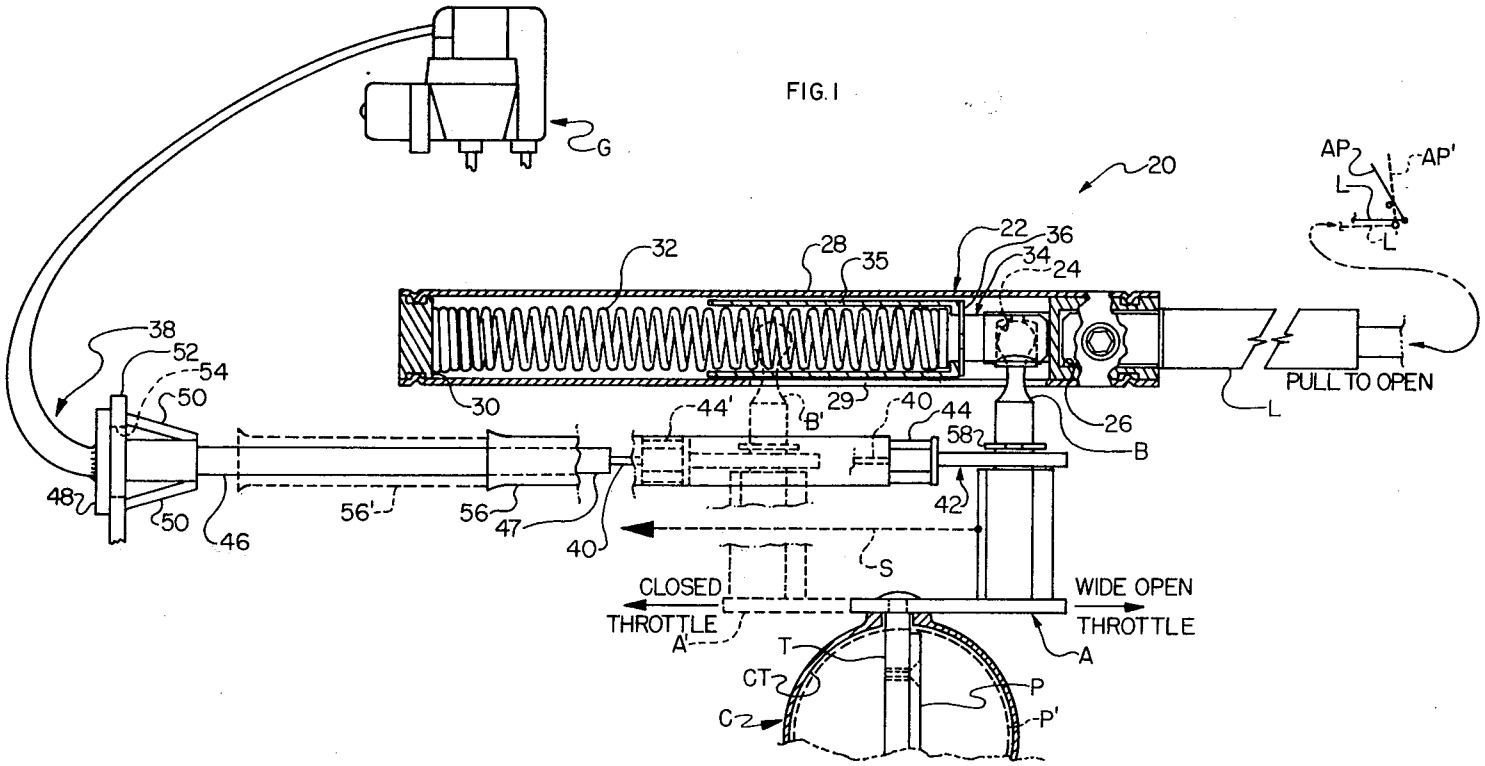
FIG. 1 is a partial cross-sectional plan view of one embodiment of the present invention in which the changeable length linkage is mounted on the ball stud of a carburetor throttle arm and includes the operated end of a flexible cable and its sheath shown schematically connected to a road speed control and/or engine governor, as well as an accelerator pedal shown schematically connected to the linkage.

The changeable length accelerator-carburetor-governor or -speed regulator linkage 20 of the present invention preferably includes a changeable length link or spring capsule unit 22 containing a clip-socket 24 for attachment to the conventional ball stud B of a conventional carburetor throttle arm or lever A of a carburetor C and a set-screwed socket member 26 for attachment to the carburetor end of a conventional accelerator pedal pull-link L, as illustrated in FIG. 1. Accelerator pedals and carburetor throttle arms are well known in the prior art, particularly in the aforesaid application Ser. No. 168,566 and U.S. Pat. No. 4,181,103 and their workings are illustrated schematically in FIG. 1.

An accelerator pedal AP as shown in FIG. 1 is connected to the pull-link L to pull it to the right and thereby also pull the ball stud B to the right to a position as shown in solid lines in FIG. 1 where the throttle arm A connected to the throttle shaft T of the carburetor C holds the throttle plate P mounted on the shaft T wide open in the throat CT of the carburetor C for full throttle operation of an internal combustion engine (not shown) associated therewith.

A conventional biasing means or spring S as schematically indicated connected to the ball stud B constantly urges the throttle arm A and ball stud B toward their closed-throttle positions as indicated in FIG. 1 in broken lines at A′ and B′ respectively, and the arm A and stud B will normally remain at the A′ and B′ positions until sufficient throttle-opening pull is exerted on the pull-link L (and thereby the arm A) to overcome the throttle-closing bias of the spring S, which bias may typically be about fourteen pounds when the arm A is at its wide open throttle position A.

The socket member 26 is fastened in one end of a tubular member 28 which forms the body of the capsule unit 22 and has an axial slot 29 therein which permits the ball stud B to pass therethrough for attachment with the clip-socket 24 and also permits the stud B to move axially of the tubular member 28. An end plug 30 fastened in the other end of the member 28 retains a capsule biasing means or spring 32 therein for biasing a movable follower 34 containing the clip socket 24 against the inner face of the set-screwed socket member 26 within the tubular member 28. A spring cover 35 retained on the follower 34 by a retaining ring 36 prevents undue "kinking" or lateral deflection of the spring 32. The capsule spring 32 may typically exert a force of about fifteen pounds against the follower 34 when the follower 34 rests against the socket member 26, such force being only slightly stronger than the aforesaid fourteen pounds bias exerted by the spring S. Then, the pull-link L can be used to pull the capsule unit 22 to its wide open throttle position as illustrated in FIG. 1, and the follower 34 will continue to be held against the socket member 26 and the length of the linkage between the accelerator pedal and the ball stud B, as formed by the link L and the capsule unit 22, will remain unchanged as though the link L were coupled directly to the ball stud B by a conventional rod end.

A conventional road speed control and/or engine governor G (such are explained in detail in the aforesaid application Ser. No. 168,566 and U.S. Pat. No. 4,181,103) is schematically illustrated in FIG. 1 and includes a conventional flexible cable and sheath assembly 38 for connecting a flexible cable 40 to the ball stud B and thereby the throttle arm A for pulling the stud B and the arm A toward their closed throttle positions B′ and A′. The cable 40 is connected to the stud B by means of a linkage eye 42 having suitable conventional connection means 44 such as a compressible ferrule for joining the cable 40 and the eye 42.

The sheath 46 of the assembly 38 includes an abutment 48 and spring latching fingers 50 for connecting the sheath 46 near its extending end 47 to the carburetor C or engine (not shown) by latching a bracket 52 connected thereto between the abutment 48 and the fingers 50, the bracket 52 having a hold 54 therein for reception of the sheath 46 therethrough and being positioned so that the end 47 extends in general alignment with the stud B for connection of the eye 42 thereto without significant flexing of the cable 40 or the sheath 46. A tubular guard 56 is attached to the connection means 44 of the eye 42 to extend therefrom for a distance somewhat greater than the movement of the cable 40 required to pull the stud B from its wide open throttle position as at B to its closed throttle position as at B′. Therefore, the guard 56 at all times covers and guards the extending end 47 and the portion of the cable 40 extending therebeyond to the connection means 44. Little or no modification of the stud B is required for reception of the eye 42 thereover and for retention of the eye 42 thereon by means of a conventional retaining ring 58 fitted thereto, and likewise the pull-link L may be used with little or no modification, so that the present invention can be readily applied to standard engines and carburetors whether such installation is made in the factory or the field.

In operation, when the accelerator is controlling the throttle arm A through the pull-link L and the capsule unit 22 without governing action from the control and/or governor G, the cable 40 is free to move in or out of the sheath 46 as needed to follow the position of the arm A and the accelerator-carburetor portion of the linkage 20 operates just as a conventional fixed-length linkage, with the follower 34 held against the socket member 26 with a force corresponding to the excess of the bias exerted thereon by the spring 32 over the bias exerted thereon by the spring S. However, when the throttle arm A has been positioned to some position intermediate between its closed and wide open throttle positions and the control and/or governor G operates as described in the aforesaid application Ser. No. 168,566 or U.S. Pat. No. 4,181,103 to pull the cable 40 into the sheath 46 far enough to urge the arm A toward its closed throttle position, then the cable 40 needs only to be pulled with enough force to overcome the aforesaid excess of the bias of spring 32 over the bias of the spring S in order to move the arm A toward its closed throttle position A; assuming that the link L is held stationary by the accelerator pedal. Stated in another way, the combined forces exerted by the cable 40 and the spring S on the follower 34 must exceed the opposite force exerted thereon by the spring 32 for the spring 32 to be further compressed from its condition as shown in FIG. 1 for changing the length of the changeable length portion of the linkage 20 as represented by the capsule unit 22, assuming again that the accelerator pedal holds the link L at least somewhat toward its wide open throttle position.

Since the spring 32 is only slightly stronger than the spring S, the force required for the operator to hold the accelerator pedal somewhat toward its wide open throttle position as just-described will be only slightly increased by the just described governor operation and consequent length-changing of the linkage 20. Concomintantly, the force required to depress the accelerator pedal and lengthen the linkage 20 during governor operation for pulling the cable 40 and arm A toward close throttle position will be only slightly greater than for accelerator pedal depression when the control and/or governor is out of operation. Thus, the operation and "feel" of the accelerator pedal is not significantly affected by operation of the control and/or governor G because the accelerator pedal may be held in or depressed to any position with only slight changes in the force required due to operation or non-operation of the control and/or governor G, and the pedal is never "taken away" from the operator as in the aforementioned prior art. The aforesaid slight increase in the force required for the operator to depress the pedal is desirable, particularly as a safety feature, since the operator will be aware that the governor is in operation, yet the "feel" of the pedal remains at the entirely acceptable level. It will be apparent that the desired "feel" can be controlled by selecting a spring 32 for a desired force.

Figure 2:
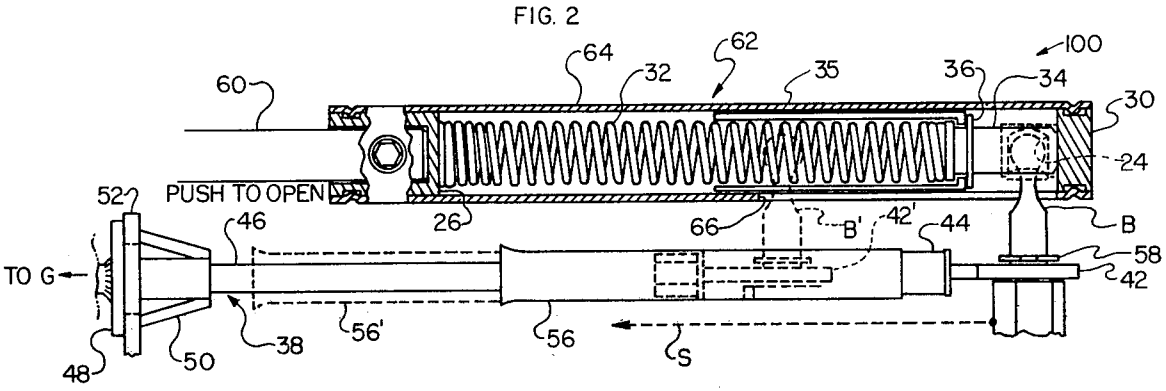
FIG. 2 is a plan view similar to FIG. 1 illustrating an alternative embodiment of the changeable length linkage elements as assembled for operation by a push-link connection to an accelerator pedal.

An alternate embodiment of the present invention is illustrated in FIG. 2 as linkage 100, and the same reference numerals used in FIG. 1 are used in FIG. 2 to identify elements which are identical to those described in connection with FIG. 1. The embodiment shown in FIG. 2 has the advantage of permitting the principles of the invention to be used with a push-link 60 connecting the accelerator pedal (not shown) to a push-type spring capsule unit 62 and thereby to the ball stud B of a carburetor C (not otherwise shown in FIG. 2). This capsule unit 62 also has a set-screwed socket member 26 fixed in one end of a tubular member 64 which forms the body of the unit 62. The member 26 provides for the reception and set-screwed attachment of the push-link 60 to the unit 62. Because the capsule unit 62 is located between the accelerator pedal (not shown) and the ball stud B, the push-link 60 must generally be a new or modified substitute for the standard push-link normally used with a particular accelerator-carburetor linkage. Again, a capsule spring 32 is captured within the tubular member 64 and is compressed against the follower 34 which is located in the member 64 adjacent the other end thereof and biased against the end plug 30 which is fixed in the aforesaid other end of the member 64. The clip-socket 24 in the follower 34 is attached to the ball stud B which extends through an axial slot 66 provided in the member 64 for such attachment. The slot 66 also permits the stub B to move axially of the member 64 with the follower 34 upon further compression of the spring 32. A spring cover 35 is retained on the follower 34 by a retaining ring 36 as described hereinbefore.

This alternative embodiment also includes a flexible cable and sheath assembly 38 (shown partially broken away) connected to a road speed control and/or engine governor G (not shown in FIG. 2), to the ball stud B, the throttle arm A (not shown in FIG. 2), and to an engine or carburetor bracket 52, just as described in connection with FIG. 1. A spring S again biases the ball stud B toward its closed throttle position at B'.

The operation of this alternative embodiment is analagous to that as described in connection with FIG. 1 in that the spring 32 of FIG. 2 holds the follower 34 against the end plug 30 during non-governed operation of the linkage 100, so that the push-link 60 and the capsule unit 62 form the equivalent of a fixed-length accelerator-carburetor linkage for control of the ball stud B between its closed and wide open positions B' and B during such non-governed operation. During governed operation of the linkage 100, when the accelerator pedal is at least partially depressed and the ball stud B is pulled leftward by the cable and sheath assembly 38 in opposition to the force exerted by the accelerator pedal and the push-link 60, the spring 32 is compressed to change the effective length of the accelerator-carburetor linkage formed by the push-link 60 and the capsule unit 62 once the combined forces exerted by the spring S and the cable and sheath assembly 38 on the ball stud B exceed the biasing force of the spring 32.

As in the first above-described embodiment, the spring S preferably biases the stud B with about fourteen pounds force when the stud B is held at wide open throttle position, and the spring 32 biases the follower 34 against the end plug 30 with about fifteen pounds force, only slightly stronger, so that the spring 32 will start to compress when the cable and sheath assembly 38 starts to exert a force more than one pound to pull the stud B from its wide open position. Thus, upon initiation of governing action, the additional force component felt by the operator at the accelerator pedal will be based on just over one pound when the acclerator pedal is fully depressed, only slightly more than the force component based on fourteen pounds required to fully depress the pedal without governing action, and the operator and feel of the accelerator pedal will not be significantly affected by the overriding operation or action of the control and/or governor G.

Figure 3:
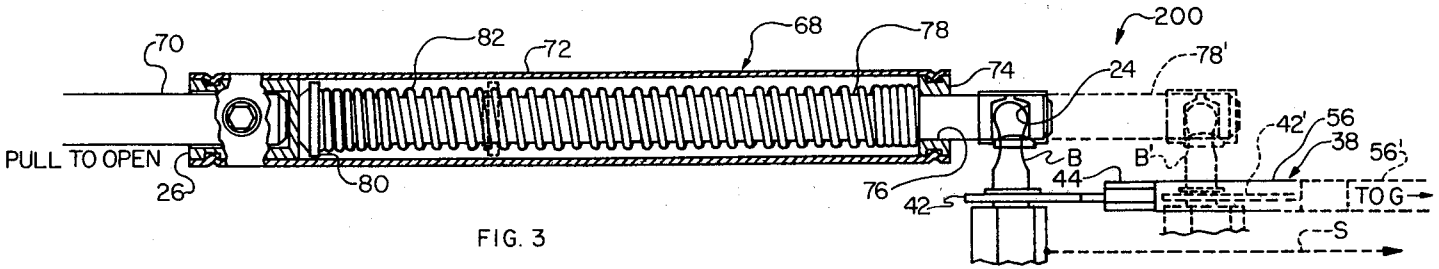
FIG. 3 is a plan view similar to FIG. 1 of a further alternative embodiment of somewhat similar changeable length linkage elements arranged for partial inclusion within the length of a pull-link connection between an accelerator pedal and a carburetor throttle arm.

A third alternative embodiment of the present invention is illustrated in FIG. 3 as linkage 200, and in FIG. 3 the same reference numerals used in FIG. 1 are again used to identify elements which are identical to elements previously described in connection with FIG. 1. In this third embodiment, the same cable and sheath assembly 38 (shown only partially) is used to connect a speed control and/or governor G (not shown in FIG. 3) to the ball stud B on the throttle arm A (not shown in FIG. 3) of a carburetor C in the same fashion as in FIGS. 1 and 2. This third embodiment employs a pull-type spring capsule unit 68 which is located between the accelerator pedal (not shown) and the ball stud B so that the pull-link 70 used therebetween must generally be modified from the standard accelerator-carburetor pull-link by suitable shortening to make room for the capsule unit 68. This location of the capusle unit 68 may be advantageous and even necessary where space is limited or non-existent for projection (as in FIG. 1) of a capsule unit 22 beyond a conventional or standard pull-link L.

The spring capsule unit 68 of FIG. 3 has a tubular body member 72, a set-screwed socket member 26 fixed in one end thereof for reception and attachment of the end of the pull-link 70 which extends toward the carburetor ball stud B, and an end bushing 74 fixed in the other end thereof, the end bushing 74 having an opening 76 extending axially therethrough. A movable elongated follower 78 having a spring retaining flange 80 at one end thereof extends from the socket member 26, adjacent which the flange 80 is located, through the tubular member 72 and the opening 76 of the end bushing 74 to a location beyond the bushing 74 where the other end thereof is provided with a clip-socket 24 for reception of the ball stud B. A capsule coil spring or biasing means 82 is located within the tubular member 72 and over the elongated portion of the follower 78, captured between the flange 80 and the end bushing 74 and compressed sufficiently for biasing the flange 80 against the socket member 26, preferably with a force of about fifteen pounds.

Unless the control and/or governor G is in governing operation, the accelerator pedal may be used to move the pull-link 70, the capsule unit 68, and the ball stud B leftward to their wide open throttle positions as shown in lines in FIG. 3 in overcoming opposition to the conventional spring or biasing means S which is connected to the stud B to bias it toward its closed throttle position as indicated at B'. The spring S preferably exerts a biasing force of about fourteen pounds when the stud B is located at its wide open throttle position, and the capsule unit 68 acts as a fixed length element with the pull-link 70 for positioning the stud B as in a conventional fixed length accelerator-carburetor linkage. However, governing operation of the control and/or governor G through the cable and sheath assembly 38 to override the accelerator-carburetor linkage by moving the stud B rightwardly from its just-described wide open throttle position will add its force to the force of the spring S already tending to pull the stud B rightwardly and will overcome the bias of the spring 82 for further compression thereof when the force exerted by the just-aforesaid governing operation exceeds one pound. Such compression of the spring 82 allows withdrawal of the follower 78 from the capsule unit 68 thereby changing its effective length and allowing the ball stud B to move rightwardly. Such governing operation will initially exert on the pull-link 70 only the additional one pound force required to overcome the spring 82 beyond the fourteen pound force already exerted on the pull-link 70 by the spring S. Therefore, the force reflected to the accelerator pedal will be only slightly greater than that already required to hold the accelerator pedal fully depressed at wide open throttle, so the operation or feel of the accelerator will not be significantly affected by the overriding governing operation.

Thus, the operation of the above-described embodiments of the present invention allow governing to occur during normal operator use of the accelerator pedal without disrupting such use by either taking the pedal away from the operator or suddenly exerting substantially greater force through the pedal back against the operator's foot, such disruption having been characteristic of prior art changeable length accelerator-carburetor-governor linkages.

The particular embodiments disclosed in full detail herein and illustrated in the drawings have been provided for disclosure purposes only and are not intended to limit the scope of the present invention, which is to be determined by the scope of the appended claims.

I claim:

1. A throttle actuator for an engine having a throttle, a governor, and a driver operated accelerator means, said actuator including:

(a) first biasing means associated with said throttle for biasing it toward its closed position;

(b) a throttle-linking means adapted to be connected between said accelerator means and said throttle and having a predetermined effective length for normally permitting said accelerator means to control the energy supply to said engine by exerting force on said throttle sufficient to overcome the biasing force exerted by said first biasing means for positioning said throttle in opposition to said first biasing means between full open and full closed positions;

(c) an overriding throttle closing linkage operated by said governor and associated with said throttle for exerting force thereon in opposition to the force exerted thereon by said throttle-linking means to urge said throttle toward its closed position under the influence of said governor; and (d) means associated with said throttle-linking means for changing said predetermined effective length thereof when said accelerator means is operated to move said throttle from its closed position and said overriding linkage is operated to move said throttle toward its closed position, said length changing means comprising:

(i) a connecting link having relatively movable elements associated respectively with said accelerator means and said throttle and (ii) second biasing means slightly stronger than said first biasing means for normally maintaining said movable elements in fixed relation to one another by exerting force therebetween during normal operation of said throttle by said accelerator means and for permitting relative movement of said movable elements to change the effective length of said throttle linking member when the combined forces exerted by said first biasing means and said overriding linkage exceed the force exerted by said second biasing means in opposition thereto whereby operation of the accelerator means is not significantly affected by the operation of said overriding means.

2. A throttle actuator according to claim 1 and characterized further in that said connecting link is self-contained and has a follower movable lengthwise of said throttle-linking means, and in that said second biasing means biases said follower against a fixed portion of said connecting link and allows said follower to move away from said fixed portion for said length changing.

3. A throttle actuator according to claim 2 and characterized further in that said connecting link essentially extends beyond said throttle away from said accelerator means.

4. A throttle actuator according to claim 2 and characterized further in that said connecting link is located essentially between said throttle and said accelerator means.

5. A throttle actuator according to claim 1, 2, 3, or 4 and characterized further in that said length changing means is shortened by said length changing.

6. A throttle actuator according to claim 1, 2, 3, or 4 and characterized further in that said length changing means is lengthened by said length changing.

* * * * *